US009546062B2

(12) United States Patent
Kakuta

(10) Patent No.: US 9,546,062 B2
(45) Date of Patent: Jan. 17, 2017

(54) SHEET CONVEYING DEVICE AND IMAGE FORMING APPARATUS HAVING THE SAME

(71) Applicant: KYOCERA Document Solutions Inc., Osaka (JP)

(72) Inventor: Masayuki Kakuta, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/074,357

(22) Filed: Mar. 18, 2016

(65) Prior Publication Data

US 2016/0280485 A1 Sep. 29, 2016

(30) Foreign Application Priority Data

Mar. 26, 2015 (JP) ..... 2015-063704

(51) Int. Cl.

| | |
|---|---|
| ***B65H 5/22*** | (2006.01) |
| ***B65H 5/36*** | (2006.01) |
| ***B65H 5/06*** | (2006.01) |
| ***B65H 29/12*** | (2006.01) |
| ***G03G 15/23*** | (2006.01) |
| *G03G 15/00* | (2006.01) |
| *B65H 9/00* | (2006.01) |

(52) U.S. Cl.

CPC ..... *B65H 5/36* (2013.01); *B65H 5/062* (2013.01); *B65H 29/125* (2013.01); *G03G 15/23* (2013.01); *B65H 9/006* (2013.01); *B65H 2301/33312* (2013.01); *B65H 2403/92* (2013.01); *B65H 2601/273* (2013.01); *G03G 15/6573* (2013.01)

(58) Field of Classification Search

CPC ..... B65H 9/006; B65H 2301/33312; B65H 2601/273; G03G 15/6573

See application file for complete search history.

(56) References Cited

U.S. PATENT DOCUMENTS

| | | | | |
|---|---|---|---|---|
| 5,430,536 | A | 7/1995 | Fullerton et al. | 355/320 |
| 6,529,259 | B1 * | 3/2003 | Kono | G03G 15/23 271/3.13 |
| 9,354,581 | B2 * | 5/2016 | Saeki | G03G 15/6573 |

(Continued)

FOREIGN PATENT DOCUMENTS

| | | | |
|---|---|---|---|
| JP | H 7-175279 | A | 7/1995 |
| JP | 2007-331948 | A | 12/2007 |

*Primary Examiner* — Howard Sanders

(74) *Attorney, Agent, or Firm* — Stein IP, LLC

(57) ABSTRACT

A sheet conveying device includes a first tray, a conveying portion, a second tray, and a conveyance control portion. The conveying portion has: a first conveying path that extends from the first tray; a second conveying path that makes the first conveying path and the second tray communicate with each other and is provided with an ejecting roller pair; a third conveying path that makes the second conveying path and an ejecting space communicate with each other and is provided with a reverse roller pair. After a first sheet passes through the reference position, the conveyance control portion stops rotation of the ejecting roller pair with the first sheet conveyed in the second conveying path nipped by the sheet ejecting roller pair, and after a second sheet passes through the reference position, the conveyance control portion rotates the reverse roller pair with the rotation of the ejecting roller pair stopped.

8 Claims, 8 Drawing Sheets

(56) References Cited

U.S. PATENT DOCUMENTS

| | | | | |
|---|---|---|---|---|
| 2009/0074493 | A1* | 3/2009 | Saeki | G03G 15/6573 399/405 |
| 2009/0200733 | A1* | 8/2009 | Saito | B65H 29/70 271/225 |
| 2009/0206546 | A1* | 8/2009 | Seki | B65H 29/14 271/207 |
| 2010/0078874 | A1* | 4/2010 | Nagata | B65H 9/006 271/110 |
| 2011/0109038 | A1* | 5/2011 | Nishizawa | B65H 5/26 271/226 |

* cited by examiner

| third motor | reverse roller | sheet ejecting roller |
|---|---|---|
| forward rotation | sheet re-feeding direction | sheet ejecting direction |
| backward rotation | temporary sheet ejecting direction | not rotated |

--Related Art--

SHEET CONVEYING DEVICE AND IMAGE FORMING APPARATUS HAVING THE SAME

INCORPORATION BY REFERENCE

The present application is based on Japanese Patent Application No. 2015-63704 filed on Mar. 26, 2015, the contents of which are hereby incorporated by reference.

BACKGROUND

The present disclosure relates to a sheet conveying device and an image forming apparatus that includes the sheet conveying device.

Conventionally, as a sheet conveying device that conveys a sheet, an automatic document conveying device is known. The automatic document conveying device conveys a document sheet placed on a document tray to a reading position, thereafter, ejects the sheet to an sheet ejecting tray. Besides, an automatic document conveying device is known, which includes a reverse conveying path to read duplex (both-surface) document images of a document sheet.

SUMMARY

A sheet conveying device according to an aspect of the present disclosure includes a first tray, a conveying portion, a second tray, and a conveyance control portion. A sheet is loaded in the first tray. The conveying portion conveys the sheet placed in the first tray in such a way that the sheet passes through a predetermined reference position. The second tray is disposed under the first tray via an ejecting space and the sheet conveyed by the conveying portion is ejected in the second tray. The conveyance control portion controls the conveying portion. The conveying portion includes: a first conveying path that is formed to extend from the first tray to the reference position; a second conveying path that is formed to extend from the reference position to the second tray; a third conveying path that is separated from the second conveying path and communicates with the ejecting space above the second tray; a fourth conveying path that is separated from the third conveying path and communicates with the first conveying path; an ejecting roller pair that is disposed in the second conveying path and rotates in a first rotation direction to eject the sheet to the second tray; a reverse roller pair that is disposed in the third conveying path and rotates in the first rotation direction to make one end of the sheet protrude into the ejecting space, thereafter, rotates in a second rotation direction opposite to the first direction to convey the sheet in a switchback manner, and reconvey the sheet from the fourth conveying path into the first conveying path; and a driving portion that generates a rotating force to rotate the ejecting roller pair and the reverse roller pair. The conveyance control portion is able to execute duplex conveyance control in which the sheet passing through the reference position with a first surface opposing the reference position is reversed, the sheet is conveyed in such a way that the sheet passes through the reference position with a second surface opposing the reference position opposite to the first surface, thereafter, the sheet is ejected to the second tray; and in a case where the conveyance control portion applies continuously the duplex conveyance control to a plurality of the sheets, after a first sheet passes through the reference position with the second surface opposing the reference position, the conveyance control portion stops the rotation of the ejecting roller pair with a rear end side of the first sheet conveyed in the second conveying path nipped by the ejecting roller pair, and after a second sheet following the first sheet passes through the reference position with the first surface opposing the reference position, the conveyance control portion rotates the reverse roller pair in the first rotation direction with the rotation of the ejecting roller pair stopped, thereby making one end of the second sheet protrude from the third conveyance path into the sheet ejecting space.

Still other objects of the present disclosure and specific advantages obtained by the present disclosure will become more apparent from the following detailed description of preferred embodiments.

DETAILED DESCRIPTION

Figure 1:
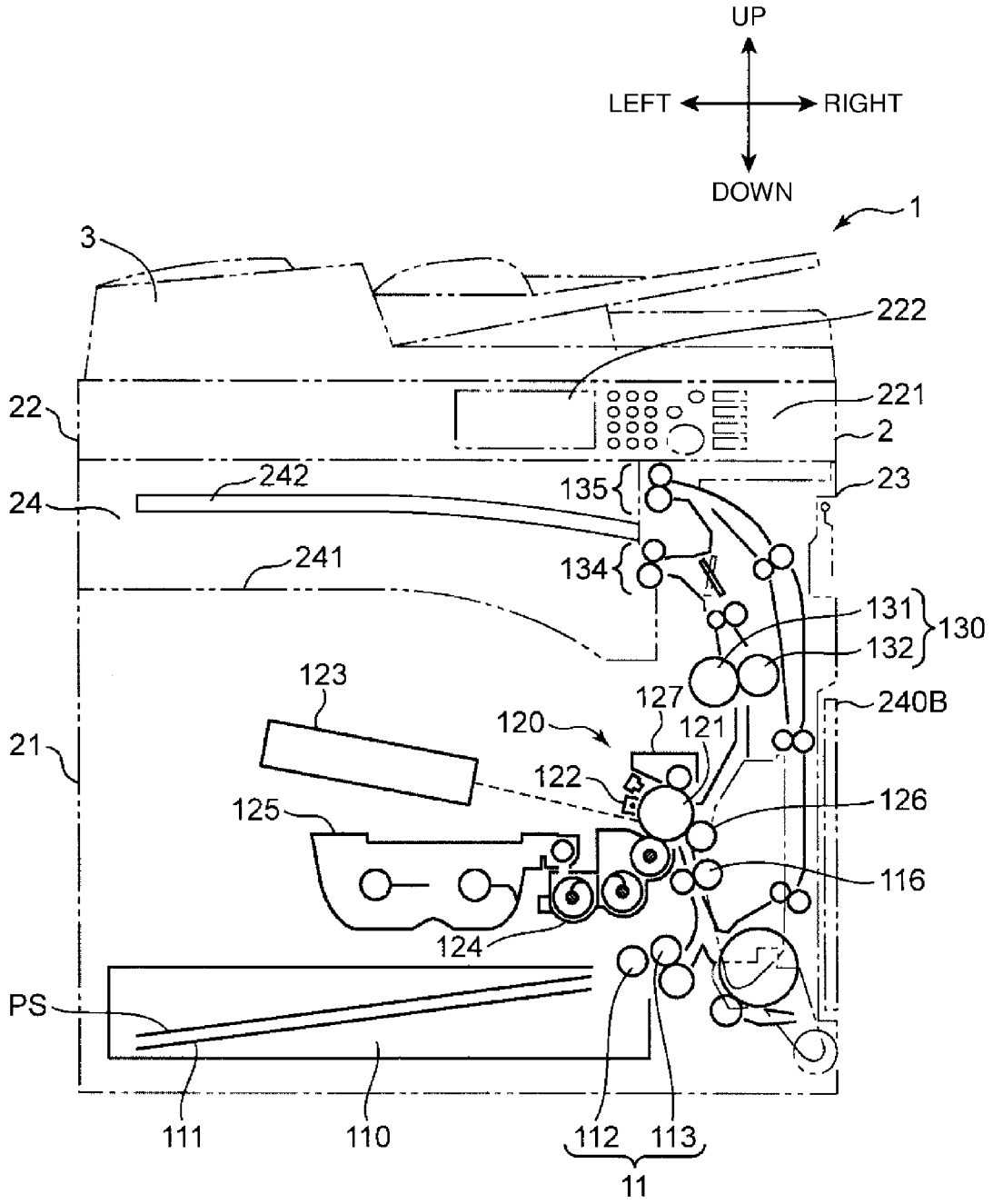
FIG. 1 is a cross-sectional view of an image forming apparatus including an automatic document conveying device according to the present disclosure.

Hereinafter, with reference to the drawings, an embodiment of the present disclosure is described. FIG. 1 is an internal cross-sectional view of an image forming apparatus 1 including an automatic document conveying device 3 according to the present disclosure. The image forming apparatus 1 shown in FIG. 1 is a so-called monochromatic printer, but in another embodiment, the image forming apparatus may be a color printer, a facsimile apparatus, a multi-functional peripheral that includes these functions, or another apparatus that forms a toner image on a sheet. In the meantime, the terms "over", "below", "front", "rear", "left", "right", which indicate directions, are merely intended for the sake of clarity of the description and do not limit the principle of the image forming apparatus. Besides, in the following description, the term "sheet" means a copy sheet, a coated paper, an OHP sheet, a cardboard, a postcard, a tracing paper, another sheet material that undergoes an image forming process, or a sheet material that undergoes an arbitrary process other than the image forming process.

The image forming apparatus 1 includes a main housing 2 that has a substantially rectangular parallelepiped shape. The main housing 2 includes a lower housing 21 that has a substantially rectangular parallelepiped shape, an upper housing 22 that is disposed over the lower housing 21 and has a substantially rectangular parallelepiped shape, and a connecting housing 23 that connects the lower housing 21 and the upper housing 22 to each other. The connecting housing 23 extends along a right edge and rear edge of the main housing 2. A sheet PS after undergoing a printing process is ejected into an ejecting space 24 enclosed by the lower housing 21, the upper housing 22, and the connecting housing 23. Especially, in the present embodiment, the sheet PS is ejected to a sheet ejecting portion 241 disposed on an upper surface of the lower housing 21 and to a sheet ejecting tray 242 disposed over the sheet ejecting portion 241. An operating portion 221 disposed in a front portion of the upper housing 22 includes an LCD touch panel 222, for example. The operating portion 221 is formed to be able to input information relevant to an image forming process.

The image forming apparatus 1 includes a sheet feeding cassette 110, a sheet feeding portion 11, a registration roller pair 116, and an image forming portion 120. The sheet feeding portion 11 includes a pickup roller 112 and a sheet feeding roller 113. The sheet feeding portion 11 feeds a sheet P in a right direction (conveying direction) from the sheet feeding cassette 110 to a sheet conveying path PP. The sheet conveying path PP is a conveying path that is disposed from the sheet feeding portion 11, and passes through a transfer position TP disposed in the image forming portion 120 via the registration roller pair 116.

The sheet feeding cassette 110 stores therein the sheet PS. The sheet feeding cassette 110 is drawable from the lower housing 21 in a front direction (direction toward the front of the paper surface of FIG. 1). The sheet feeding cassette 110 includes a lifting plate 111 that supports the sheet PS. The lifting plate 111 inclines to push up a tip end edge of the sheet P.

The pickup roller 112 is disposed over the tip end edge of the sheet P that is pushed up by the lifting plate 111. When the pickup roller 112 rotates, the sheet PS is drawn from the sheet feeding cassette 110. The sheet feeding roller 113 is disposed on a downstream side of the pickup roller 112 in the sheet conveying direction. The sheet feeding roller 113 sends further the sheet PS downstream in the sheet conveying direction.

The registration roller pair 116 conveys the sheet PS to the image forming portion 120 in accordance with a timing when a toner image is transferred to the sheet PS in the image forming portion 120. Besides, the registration roller pair 116 has a function in which when a sheet hits a nip portion of the registration roller pair 116, an inclination movement (skew) of the sheet PS with respect to the sheet conveying direction is corrected.

The image forming portion 120 includes a photosensitive drum 121, an electrifier 122, a light exposing device 123, a developing device 124, a toner container 125, a transfer roller 126, and a cleaning device 127.

On a more downstream side than the image forming portion 120 in the conveying direction, the image forming apparatus 1 further includes a fixing device 130 that fixes a toner image on the sheet PS. The fixing device 130 includes a heat roller 131 that melts the toner on the sheet PS and a pressure roller 132 that presses the sheet PS against the heat roller 131. When the sheet PS passes through between the heat roller 131 and the pressure roller 132, the toner image is fixed to the sheet PS.

The image forming apparatus 1 further includes a lower ejecting roller 134, an upper ejecting roller 135. The lower ejecting roller 134 ejects the sheet PS to the sheet ejecting portion 241. The upper ejecting roller 135 ejects the sheet PS to the sheet ejecting tray 242.

Figure 2:
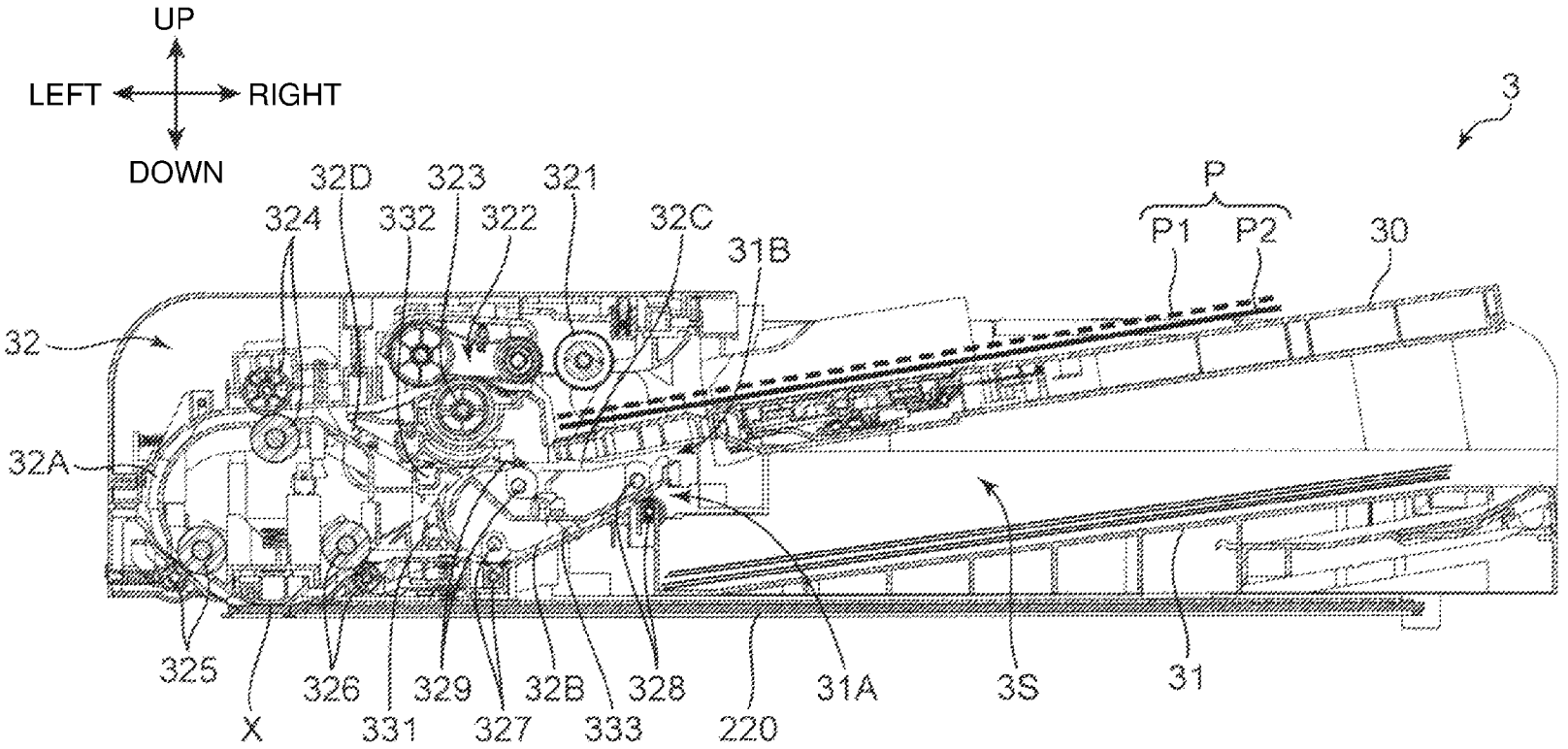
FIG. 2 is a side cross-sectional view of an automatic document conveying device according to an embodiment of the present disclosure.
Figure 3A:
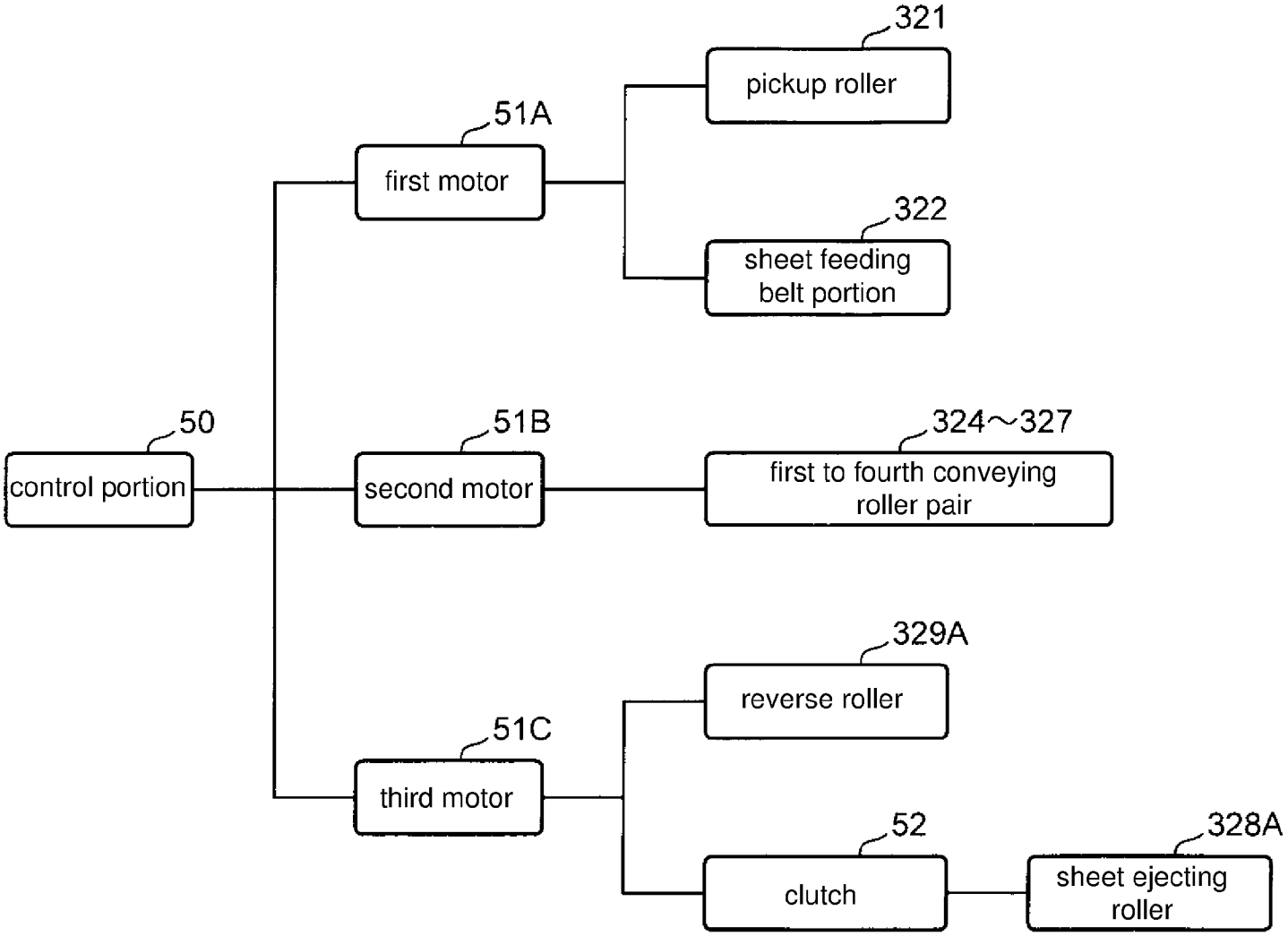
FIG. 3A is a block diagram showing a portion of a driving mechanism of an automatic document conveying device according to the present embodiment.
Figures 3B, 4:
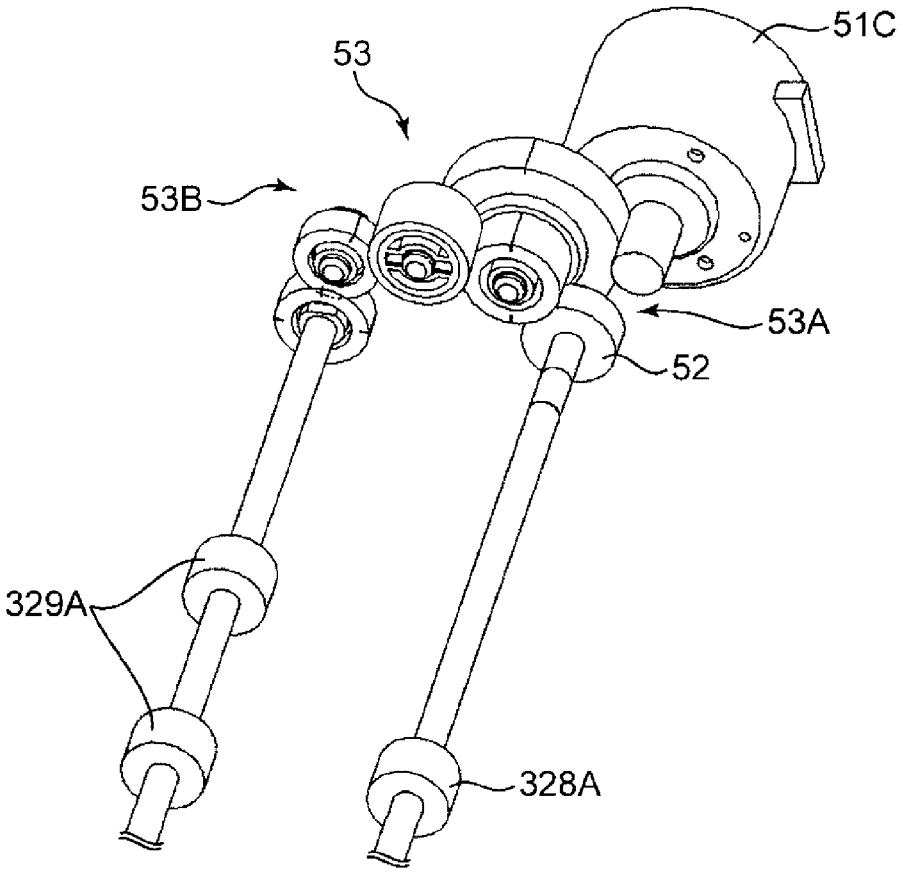
FIG. 3B is a perspective view showing a portion of a driving mechanism of an automatic document conveying device according to the present embodiment.
FIG. 4 is a view showing a relationship among rotation directions of a motor, a reverse roller, and a sheet ejecting roller of an automatic document conveying device according to the present embodiment.

Next, the automatic document conveying device 3 as an example of the sheet conveying device according to the present disclosure is described in detail. FIG. 2 is a cross-sectional view of the automatic document conveying device 3 according to an embodiment of the present disclosure. FIG. 3A is a block diagram showing a driving mechanism of the automatic document conveying device 3 according to the present embodiment. FIG. 3B is a perspective view showing a portion of the driving mechanism of the automatic document conveying device 3 according to the present embodiment.

The automatic document conveying device 3 is formed into a flat box shape that has a predetermined height in a vertical direction and extends in front-rear and left-right directions. The automatic document conveying device 3 is pivotable upward with respect to the upper housing 22 (FIG. 1) about a not-shown fulcrum portion disposed on a rear end side. When the automatic document conveying device 3 is pivoted, a stationary document is placed on a contact glass 220 (FIG. 2) disposed on an upper surface portion of the upper housing 22. Besides, when the automatic document conveying device 3 is closed to be disposed on the upper housing 22 (FIG. 1), the automatic document conveying device 3 conveys successively the document sheets P to a document reading position X formed in a left end portion of the contact glass 220. The document reading position X is disposed to oppose a not-shown reading device that reads document images formed on a front surface (first surface) and rear surface (second surface) of the document sheet P. The reading device is disposed in the upper housing 22.

The automatic document conveying device 3 includes a document feeding tray 30 (first tray), a document ejecting tray 31 (second tray), and a document conveying portion 32

(conveying portion). The document feeding tray 30 is composed of a flat plate that is extended to descend obliquely to a lower left position, and the document sheet P is placed on an upper surface. The document ejecting tray 31 is a flat plate portion which is disposed under the document feeding tray 30 via an ejecting space 3S, and to which the document sheet P conveyed by the document conveying portion 32 is ejected. The document conveying portion 32 conveys the document sheet P placed on the document feeding tray 30 in such a way that the document sheet P passes through the document reading position X (reference position).

The document conveying portion 32 includes a first conveying path 32A, a second conveying path 32B, a third conveying path 32C, and a fourth conveying path 32D.

The first conveying path 32A is a conveying path that is extended from the document feeding tray 30 to the document reading position X. The first conveying path 32A extends leftward from the document feeding tray 30 and is disposed in such a way that a left end side is bent into a C shape. The second conveying path 32B is a conveying path that is extended from the document reading position X to the document ejecting tray 31. The second conveying path 32B extends rightward from the document reading position X and is inclined in such a way that a right end side rises upward obliquely. The second conveying path 32B communicates with the ejecting space 3S. And, a document ejection opening 31A is formed at a downstream end of the second conveying path 32B. The document sheet P is ejected from the document ejection opening 31A into the ejecting space 3S.

The third conveying path 32C is a conveying path that is separated from the second conveying path 32B and communicates with the ejecting space 3S above the document ejecting tray 31. The third conveying path 32C extends from a downstream-side position very close to the document reading position X to rise obliquely upward to a right upper position, and a right end side extends substantially horizontally. And, a reverse ejection opening 31B is formed at a downstream end of the third conveying path 32C. During a duplex printing time, a portion of the document sheet P protrudes from the reverse ejection opening 31B into the ejecting space 3S. The fourth conveying path 32D is a conveying path that makes the third conveying path 32C and the first conveying path 32A communicate with each other. The fourth conveying path 32D is extended further leftward from a left end portion of the horizontal portion of the third conveying path 32C. The fourth conveying path 32D joins a position that is located on a more upstream side than the document reading position X of the first conveying path 32A in the conveying direction and on a downstream side of a sheet feeding belt portion 322. The fourth conveying path 32D functions as a reverse conveying path that reverses the document sheet P.

Besides, the document conveying portion 32 includes a pickup roller 321, the sheet feeding belt 322, an opposing roller 323, a first conveying roller pair 324, a second conveying roller pair 325, a third conveying roller pair 326, a fourth conveying roller pair 327, a sheet ejecting roller pair 328, and a reverse roller pair 329.

The pickup roller 321 sends the document sheet P placed on the document feeding tray 30 to the first conveying path 32A. In the meantime, a not-shown lifting plate is disposed on a downstream-side portion of the document feeding tray 30 in the conveying direction. When the lifting plate is moved upward by a not-shown step-up/down mechanism, the document sheet P placed on the document feeding tray 30 comes into contact with the pickup roller 321.

The sheet feeding belt portion 322 conveys further the document sheet P sent by the pickup roller 321. The sheet feeding belt portion 322 is composed of a pair of mounting rollers and a belt mounted between the mounting rollers. The opposing roller 323 is a roller that is in contact with the belt between the pair of mounting rollers of the sheet feeding belt portion 322. In a case where a plurality of the document sheets P are sent by the pickup roller 321, only one document sheet P is conveyed into the first conveying path 32A by the sheet feeding belt portion 322 and the opposing roller 323.

The first conveying roller pair 324 is a roller pair that is disposed in the first conveying path 32A. The first conveying roller pair 324 is disposed at a downstream-side position very close to the joining portion where the fourth conveying path 32D joins the first conveying path 32A. The first conveying roller pair 324 functions as a registration roller pair that adjusts a timing when the document sheet P is conveyed to the document reading position X and corrects an oblique movement of the of the document sheet P. The second conveying roller pair 325 is a roller pair that is disposed on a more downstream side than the first conveying roller pair 324 in the conveying direction and at an upstream-side position very close to the document reading position X. The document sheet P is conveyed to the document reading position X by the first conveying roller pair 324 and the second conveying roller pair 325. The third conveying roller 326 is a roller pair disposed on a downstream side of the document reading position X in the conveying direction. The document sheet P is conveyed into the second conveying path 32B or the third conveying path 32C by the third conveying roller pair 326. The fourth conveying roller pair 327 is a roller pair disposed in the second conveying path 32B.

The sheet ejecting roller pair 328 is a roller pair disposed at a position that is located in a downstream-side end portion of the second conveying path 32B and near the document ejection opening 31A. The document sheet P is ejected from the document ejection opening 31A to the ejecting space 3S (document ejecting tray 31) by rotation of the sheet ejecting roller pair 328. The sheet ejecting roller pair 328 is rotated by a third motor 51C described later. Besides, the sheet ejecting roller pair 328 has a function to temporarily nip the document sheet P.

The reverse roller pair 329 is a roller pair disposed in the third conveying path 32C. The reverse roller pair 329 conveys the document sheet P to the ejecting space 3S. Besides, the reverse roller pair 329 conveys the document sheet P to the fourth conveying path 32D. In other words, the reverse roller pair 329 has a function in which by rotating forward the reverse roller pair 329, one end of the document sheet P is made to protrude into the ejecting space 3S, thereafter, by rotating backward the reverse roller pair 329, the document sheet P is conveyed in a switchback manner, whereby the document sheet P is reconveyed from the fourth conveying path 32D to the first conveying path 32A. The reverse roller pair 329 is rotated by the third motor 51C described later.

Further, the document conveying portion 32 includes a first switching guide 331, a second switching guide 332, and an actuator 333 (detecting portion).

The first switching guide 331 is a guide member that is disposed on a downstream side of the third conveying roller pair 326. The first switching guide 331 is pivotable about a not-shown fulcrum portion as a pivotal point. The first switching guide 331 has a substantially triangular shape in the cross-sectional view shown in FIG. 2. When a vertex portion disposed on a left end side of the first switching guide 331 is moved upward, the document sheet P is conveyed into the second conveying path 32B. On the other hand, when the vertex portion of the first switching guide 331 is moved downward, the document sheet P is conveyed into the third conveying path 32C.

The second switching guide 332 is a guide member disposed above the first switching guide 331. The second switching guide 332 is disposed near a boundary between the third conveying path 32C and the fourth conveying path 32D. The second switching guide 332 is pivotable about a not-shown fulcrum portion as a pivotal point. The second switching guide 332 has a substantially triangular shape in the cross-sectional view shown in FIG. 2. When a vertex portion disposed on a right end side of the second switching guide 332 is moved upward, the document sheet P conveyed in the third conveying path 32C is conveyed to the ejecting space 3S via the reverse election opening 31B. On the other hand, when the vertex portion of the second switching guide 332 is moved downward, the document sheet P is conveyed from the third conveying path 32C into the fourth conveying path 32D.

The actuator 333 is disposed in a region that is inclined to rise obliquely upward toward the ejecting space 3S of the second conveying path 32B. The actuator 333 is located at an upstream-side position very close to the sheet ejecting roller pair 328. The actuator 333 detects a tip end portion or rear end portion of the document sheet P in the conveying direction. The detection result of the document sheet P detected by the actuator 333 is transmitted to a control portion 50 and checked during a later-described conveyance control time of the document sheet P.

The automatic document conveying device 3 includes the control portion 50 (conveyance control portion), a first motor 51A, a second motor 51 B, the third motor 51C (driving portion), a clutch 52, and a transmitting gear portion 53 (drive transmitting mechanism). The control portion 50 controls a driving mechanism and each member of the document conveying portion 32. The first motor 51A, the second motor 51B, and the third motor 51C compose the driving mechanism of the document conveying portion 32. With reference to FIG. 3A, the first motor 51A is a sheet feeding motor that rotates and drives the pickup roller 321 and the sheet feeding belt portion 322 which are described above. The second motor 51 B is a conveying motor that rotates and drives the first conveying roller pair 324, the second conveying roller pair 325, the third conveying roller pair 326, and the fourth conveying roller pair 327 that are described above. Further, the third motor 51C is a reversing and ejecting motor that rotates and drives the sheet ejecting roller pair 328 and the reverse roller pair 329 that are described above.

The third motor 51C is rotatable forward and backward. In other words, the third motor 51C is rotatable in a first rotation direction and a second rotation direction opposite to the first rotation direction. The third motor 51C generates a rotating force for rotating the sheet ejecting roller pair 328 and the reverse roller pair 329. The clutch 52 is a known one-way clutch. The transmitting gear portion 53 is a gear group composed of a plurality of gears. The transmitting gear portion 53 includes a first transmitting portion 53A and a second transmitting portion 53B. The first transmitting portion 53A transmits a rotating force to the sheet ejecting roller pair 328. Besides, the second transmitting portion 53B transmits a rotating force to the reverse roller pair 329. Especially, as shown in FIG. 3B, the first transmitting portion 53A is connected to a rotation shaft of a sheet ejecting roller 328A that is one roller of the sheet ejecting roller pair 328. Besides, the second transmitting portion 53B is connected to a rotation shaft of a reverse roller 329A that is one roller of the reverse roller pair 329. As a result of this, the transmitting gear portion 53 transmits the rotating force from the third motor 51C to the sheet ejecting roller 328A and the reverse roller 329A. In the meantime, in the present embodiment, a rotation direction of the sheet ejecting roller 328A and a rotation direction of the reverse roller 329A are the same as each other. Because of this, the sheet ejecting roller 328A is an upper roller of the sheet ejecting roller pair 328, and the reverse roller 329A is a lower roller of the reverse roller pair 329. As a result of this, as described later, by controlling the rotation direction of the third motor 51C, it becomes possible to control the ejection and reverse of the document sheet P. In the meantime, in another embodiment, the sheet ejecting roller 328A may be a lower roller of the sheet ejecting roller pair 328, and the reverse roller 329A may be an upper roller of the reverse roller pair 329. Besides, the other roller of the sheet ejecting roller pair 328 and the other roller of the reverse roller pair 329 rotate following the sheet ejecting roller pair 328 and the reverse roller pair 329, respectively. The above clutch 52 is disposed to exist between the third motor 51C and the sheet ejecting roller 328A. And, the clutch 52 composes a portion of the first transmitting portion 53A.

The rotations of the first motor 51A, second motor 51B, and third motor 51C are controlled by the control portion 50. Besides, the control portion 50 controls the rotation of the sheet ejecting roller pair 328 in accordance with a detection result from the actuator 333.

FIG. 4 is a view showing a relationship among the rotation directions of the third motor 51 C, reverse roller 329A, and sheet ejecting roller 328A of the automatic document conveying device 3 according to the present embodiment. With reference to FIG. 4, when the third motor 51C is rotated forward (first rotation direction), the rotating force (first rotating force) of the third motor 51 C rotates the reverse roller 329A in a sheet re-feeding direction. The sheet re-feeding direction is a rotation direction of the reverse roller 329A by which the document sheet P is conveyed from the third conveying path 32C into the first conveying path 31A via the fourth conveying path 32D. Besides, the sheet ejecting roller 328A is rotated in an ejecting direction by the first rotating force. The ejecting direction is a rotation direction of the sheet ejecting roller 328A by which the document sheet P is ejected from the second conveying path 32B into the ejecting space 3S.

On the other hand, when the third motor 51C is rotated backward (second rotation direction), the reverse roller 329A is rotated in a temporary ejecting direction by the rotating force (second rotating force) of the third motor 51C. The temporary ejecting direction is a rotation direction of the reverse roller 329A by which a tip end side of the document sheet P is ejected from the third conveying path 32C into the ejecting space 3S via the reverse ejection opening 31 B. Besides, when the third motor 51C is rotated backward, the transmission of the rotating force to the sheet ejecting roller 328A is interrupted by the clutch 52.

Figure 5:
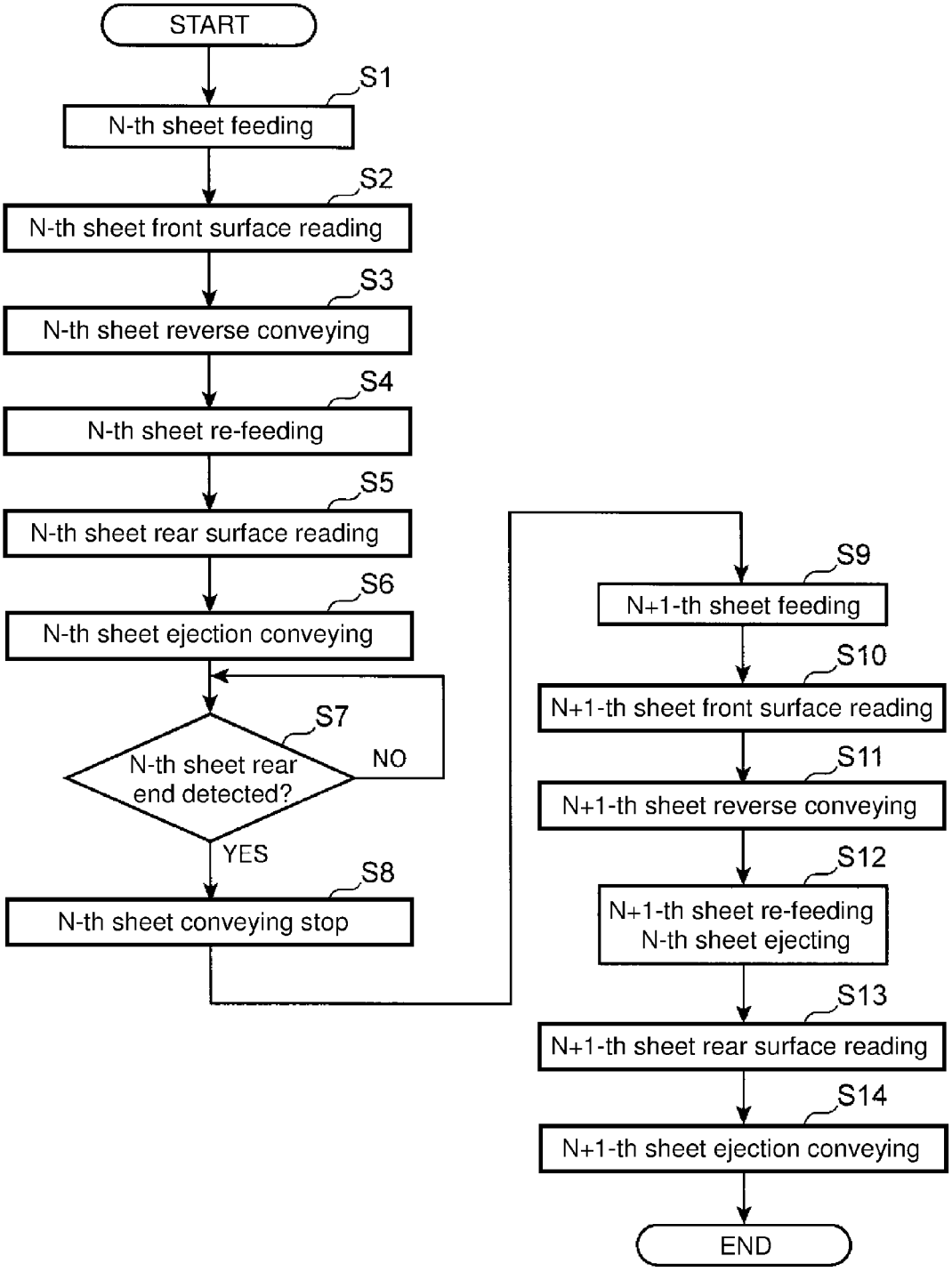
FIG. 5 is a flow chart showing a sheet conveying procedure of an automatic document conveying device according to the present embodiment.

Next, as to the automatic document conveying device 3 according to the present embodiment, a form in which the document sheet P is conveyed is described. FIG. 5 is a flow chart showing a conveying procedure of the document sheet P in the automatic document conveying device 3 according to the present embodiment. FIG. 6A to FIG. 6C, and FIG. 7A to FIG. 7C are each a cross-sectional view showing a form in which a plurality of the document sheets P are successively conveyed in the automatic document conveying device 3. Further, FIG. 8 is a cross-sectional view showing a form in which the plurality of the document sheets P are successively conveyed in a conventional automatic document conveying device that is compared with the automatic document conveying device 3 according to the present embodiment.

Figure 8:
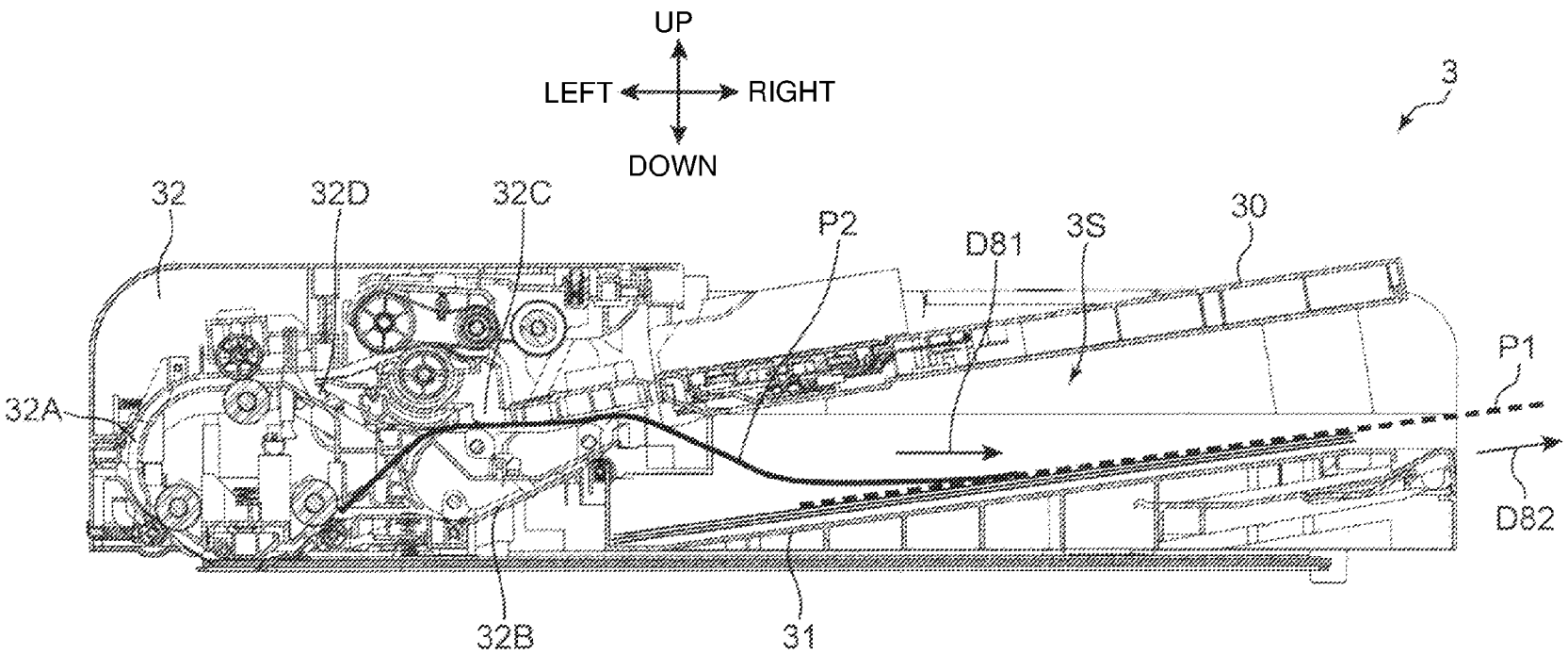
FIG. 8 is a cross-sectional view showing a form in which a plurality of sheets are successively conveyed in a conventional automatic document conveying device.

In the conventional automatic document conveying device shown in FIG. 8, during a duplex conveying time when the plurality of the document sheets P (first sheet P1, second sheet P2) loaded in the document feeding tray 30 are conveyed in the first conveying path 32A, the second conveying path 32B, the third conveying path 32C and the fourth conveying path 32D in such a way that a front surface and rear surface of the document sheet P successively pass through the document reading position X; thereafter, the document sheet P is ejected to the document ejecting tray 31, there is a disadvantage described below. First, a duplex conveyance of the first sheet P1 ends, and the first sheet P1 is ejected to the document ejecting tray 31. In the meantime, in FIG. 8, the plurality of the document sheets P are loaded in the document ejecting tray 31 before the first sheet P1. The first sheet P1 is loaded in the document ejecting tray 31, thereafter, the second sheet P2 is conveyed into the first conveying path 32A. And, a front surface of the second sheet P2 passes through the document reading position X, thereafter, for rear surface reading, the second sheet P2 is conveyed into the third conveying path 32C. In order for the second sheet P2 to be conveyed in a switchback manner, a rear end portion of the second sheet P2 needs to pass through the second switching guide 332. At this time, a tip end portion of the second sheet P2 is ejected into the ejecting space S3 and sags down under its own weight. And, the tip end portion of the second sheet P2 pushes downward a sheet surface of the first sheet P1 in an arrow D81 direction. As a result of this, the first sheet P1 placed in the document ejecting tray 31 is pushed out rightward from the document ejecting tray 31 (arrow D82 of FIG. 8). As described above, during the duplex conveyance time of the plurality of the document sheets P, there is a problem that a defective alignment of the document sheep P loaded in the document ejecting tray 31 occurs. In the meantime, to solve the problem shown in FIG. 8, another tray may be mounted in a portion that is between the document feeding tray 30 and the document ejecting tray 31 and right under the reverse ejection opening 31B (FIG. 2). In this case, the tip end portion of the second sheet P2 ejected in the ejecting space 3S does not sag dawn. Accordingly, the above defective alignment is alleviated. However, in this case, a new tray is required, and cost of the automatic document conveying device 3 increases. Further, the other tray covers an upper side of the document ejecting tray 31. Accordingly, takeability when taking out the document sheet P ejected to the document ejecting tray 31 from the front side or rear side of the automatic document conveying device 3 deteriorates. Further, in a case where the document sheet P is stuck around the document ejection opening 31A (FIG. 2), the takeability of the document sheet P also deteriorates.

To solve such problems, in the automatic document conveying device 3 according to the present embodiment, the control portion 50 controls the rotation operations of the sheet ejecting roller pair 328 and reverse roller pair 329.

With reference to FIG. 5, a conveying procedure when the duplex conveyance of the document sheet P is performed in the automatic document conveying device 3 according to the present embodiment is described. In the meantime, an N-th document sheet P in FIG. 5 corresponds to the first sheet P1 in FIG. 6A to FIG. 7C, and an N+1-th document sheet P in FIG. 5 corresponds to the second sheet P2. When each motor is controlled by the control portion 50 and the first sheet P1 is fed from the document feeding tray 30 (step S1, FIG. 6A), an image on a front surface of the first sheet P1 is read by the not-shown reading device at the document reading position X (step S2). Thereafter, the first sheet P1 is conveyed in the third conveying path 32C in the switchback manner (step S3), and re-fed from the fourth conveying path 32D to the first conveying path 32A (step S4). And, an image on a rear surface of the first sheet P1 is read at the document reading position X (step S5).

Figure 6A:
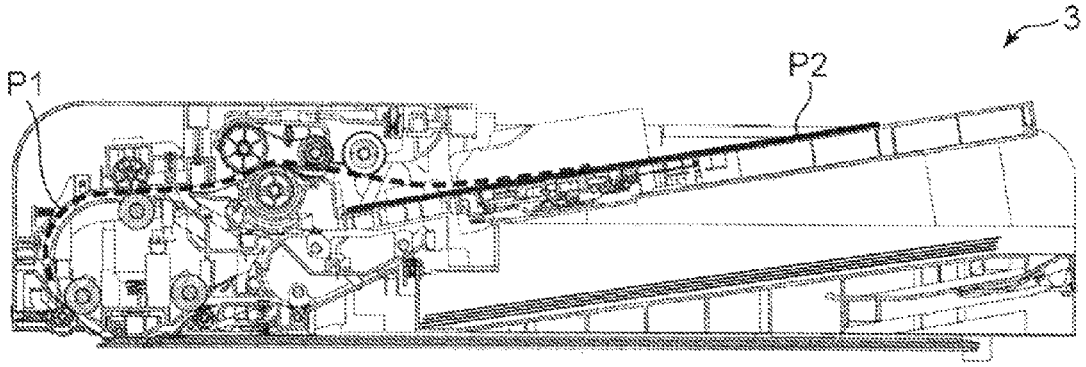
FIG. 6A is a cross-sectional view showing a form in which a plurality of sheets are successively conveyed in an automatic document conveying device according to the present embodiment, namely, a view showing a form in which a first sheet is conveyed in a first conveying path.
Figure 6B:
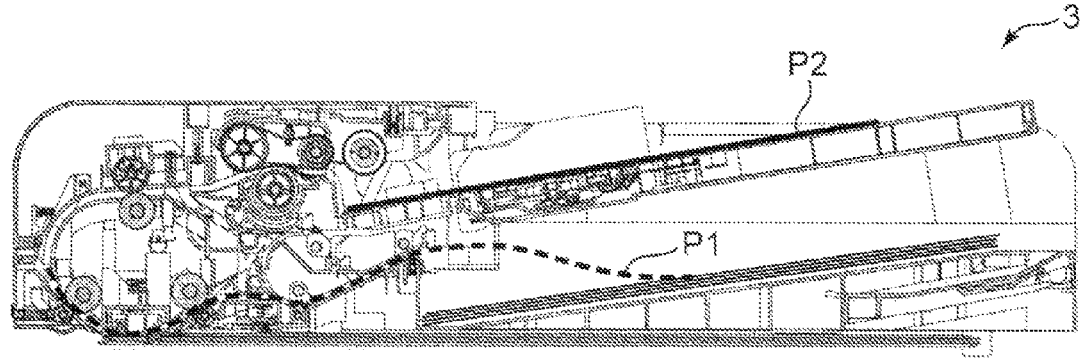
FIG. 6B is a cross-sectional view showing a form in which a plurality of sheets are successively conveyed in an automatic document conveying device according to the present embodiment, namely, a view showing a form in which a first sheet is conveyed in a second conveying path.
Figure 6C:
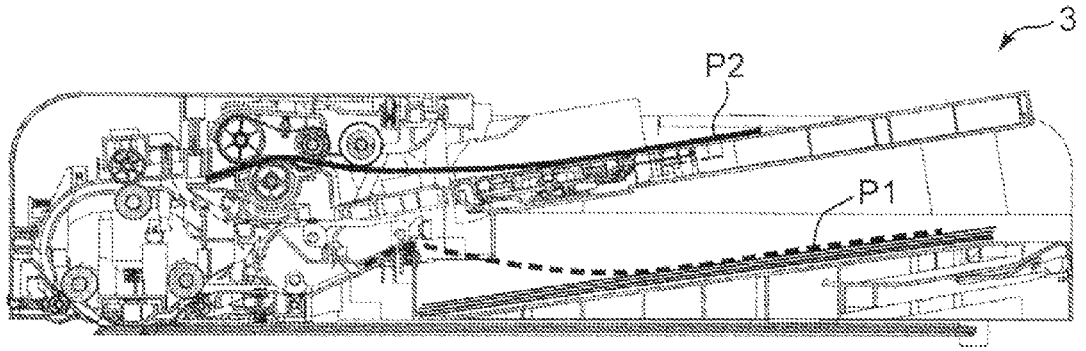
FIG. 6C is a cross-sectional view showing a form in which a plurality of sheets are successively conveyed in an automatic document conveying device according to the present embodiment, namely, a view showing a form in which a second sheet is conveyed into a first conveying path.

Thereafter, an ejecting conveyance of the first sheet P1 is executed (step S6). In the present embodiment, the first sheet P1 whose image on the rear surface is read is guided again to the third conveying path 32C and conveyed in the switchback manner, thereafter, conveyed from the fourth conveying path 32D into the first conveying path 32A. Thereafter, the first sheet P1 passes through the document reading position X and is conveyed into the second conveying path 32B. And, the control portion 50 rotates forward the third motor 51C, whereby the sheet ejecting roller pair 328 is rotated in the ejecting direction. During this time, the document sheet P does not exist in the third conveying path 32C, but the reverse roller pair 329 is being rotated in the sheet re-feeding direction. A tip end portion of the first sheet P1 is ejected from the document ejection opening 31A into the ejecting space 3S (FIG. 6B), thereafter, the control portion 50 continues to refer to a detection result from the actuator 333 until a rear end portion of the first sheet P1 reaches the actuator 333 (NO in a step S7). Thereafter, when the rear end portion of the first sheet P1 reaches the actuator 333 (YES in the step S7), the control portion 50 immediately stops the rotation of the third motor 51C (step S8). As a result of this, the rotation of the sheet ejecting roller pair 328 stops with the rear end portion of the first sheet P1 nipped by the sheet ejecting roller pair 328 (FIG. 6C).

Figure 7A:
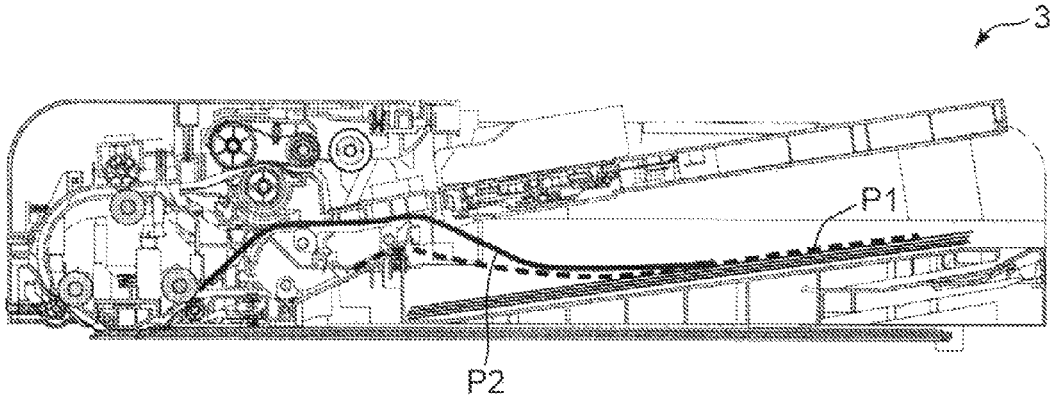
FIG. 7A is a cross-sectional view showing a form in which a plurality of sheets are successively conveyed in an automatic document conveying device according to the present embodiment, namely, a view showing a form in which a tip end portion of a second sheet protrudes from a third conveying path onto a document ejecting tray with a rear end portion of a first sheet nipped by a sheet ejecting roller pair.
Figure 7B:
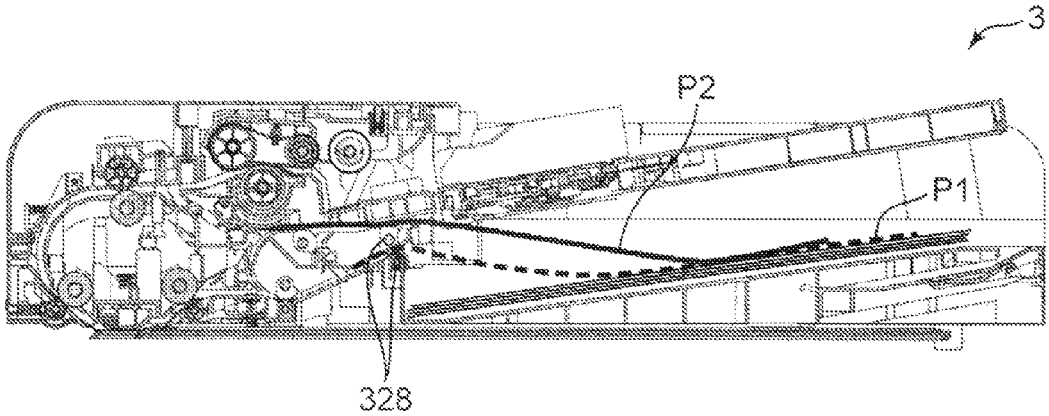
FIG. 7B is a cross-sectional view showing a form in which a plurality of sheets are successively conveyed in an automatic document conveying device according to the present embodiment, namely, a view showing a form in which a first sheet is ejected onto a document ejecting tray and a second sheet is conveyed in a switchback manner in a third conveying path.
Figure 7C:
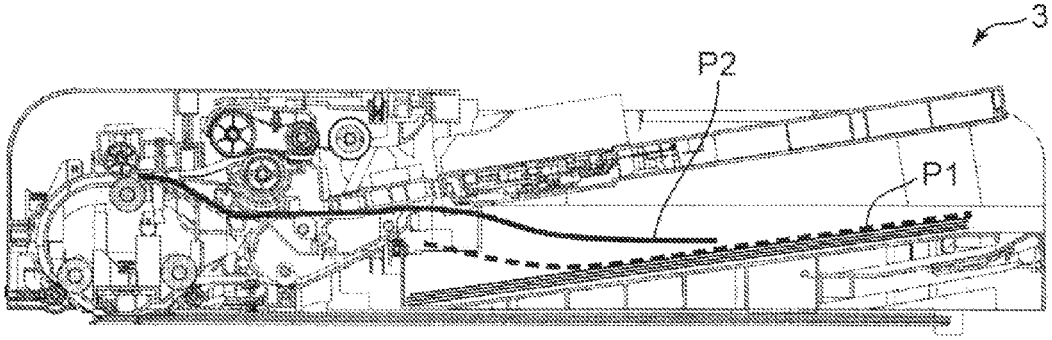
FIG. 7C is a cross-sectional view showing a form in which a plurality of sheets are successively conveyed in an automatic document conveying device according to the present embodiment, namely, a view showing a form in which a first sheet is ejected onto a document ejecting tray and a second sheet is conveyed from a third conveying path to a first conveying path.

The control portion 50 feeds the second sheet P2 from the document feeding tray 30 with the first sheet P1 nipped by the sheet ejecting roller pair 328 (step 9 of FIG. 5). An image on the front surface of the second sheet P2 is read by the not-shown reading device at the document reading position X (step S10). Thereafter, the second sheet P2 is conveyed into the third conveying path 32C. During this time, the control portion 50 rotates backward the third motor 51C. As a result of this, the reverse roller pair 329 is rotated in the temporary ejecting direction, and the tip end portion of the second sheet P2 is ejected from the reverse ejection opening 31 B into the ejecting space 3S (step S11 of FIG. 5, FIG. 7A). In the meantime, during this time, the rotation of the sheet ejecting roller pair 328 is kept in the stop state by operation of the clutch 52. Accordingly, as shown in FIG. 7A, even if the tip end portion of the second sheet P2 sags down, the first sheet P1 nipped by the sheet ejecting roller pair 328 is not pushed out rightward.

When the tip end side of the second sheet P2 is ejected into the ejecting space 3S, and the rear end portion of the second sheet P2 passes through the second switching guide 332 (FIG. 2) (FIG. 7B), the control portion 50 switches the rotation direction of the third motor 51C from the backward rotation to the forward direction. At this moment, the sheet ejecting roller pair 328 is rotated in the ejecting direction, and the first sheet P1 is ejected to the document ejecting tray 31. At the same time, the reverse roller pair 329 is rotated in the sheet re-feeding direction (reversed), and the second sheet P2 is conveyed in the switchback manner (step S12, FIG. 7C). Thereafter, the second sheet P2 is reconveyed into the first conveying path 32A, and an image on a rear surface of the second sheet P2 is read at the document reading position X (step S13). Further, the second sheet P2, whose image on the rear surface is read, is guided again to the third conveying path 32C, conveyed in the switchback manner, thereafter, conveyed from the fourth conveying path 32D into the first conveying path 32A. Thereafter, the second sheet P2 passing through the document reading position X is conveyed into the second conveying path 32B, and ejected to the document ejecting tray 31 in accordance with the forward rotation of the third motor 51C. In the meantime, in a case where the document sheet P following the second sheet P2 is further fed, like the first sheet P1, the control portion 50 stops the rotation of the third motor 51C with the second sheet P2 nipped by the sheet ejecting roller pair 328. In the meantime, as described above, the document sheet P, whose image on the rear surface is read, is reversed again via the third conveying path 32C and the fourth conveying path 32D, thereafter, ejected to the document ejecting tray 31. A bundle of document sheets ejected to the document ejecting tray 31 are ejected with the rear surface facing upward in such a way that the lowermost document sheet P becomes the first document. In other words, by taking out and reversing the bundle of the document sheets P ejected to the document ejecting tray 31, the bundle of the document sheets P returns to the state of being placed on the document feeding tray 30.

In the meantime, as to the document sheet P ejected to the document ejecting tray 31, the rear end passes through the sheet ejecting roller pair 328, obliquely climbs up the inclination of the document ejecting tray 31 with the aid of inertial force, thereafter, slides down along the inclination, and loaded at the lowermost portion of the inclination with the rear end aligned. Here, if the second sheet P2 is conveyed in the switchback manner and protrudes from the third conveying path 32C to the document ejecting tray 31 before the first sheet P1 is aligned and loaded, there is a risk that the first sheet P1 being loaded would be pushed out from the document ejecting tray 31 by the second sheet P2 to disturb the load state.

But, when the second sheet P2 is in a second switchback, the first sheet P1 already slides down along the inclination of the document ejecting tray 31 and is loaded with the rear end aligned. Accordingly, there is no risk that the second sheet P2 would protrude from the third conveying path 32C to the document ejecting tray 31 to disturb the load state. Besides, even when a one-surface conveyance of the document sheet P is performed, the same state as in the second switchback time occurs, and at the ejecting time of the second sheet P2, the first sheet P1 is already aligned and loaded. Accordingly, there is almost no influence on the load state.

As described above, in the present embodiment, the front surface and rear surface of the first sheet P1 pass through the document reading position X, thereafter, the control portion 50 stops the rotation of the sheet ejecting roller pair 328 with the rear end side of the first sheet P1 conveyed in the second conveying path 32B nipped by the sheet ejecting roller pair 328. And, the front surface of the second sheet P2 passes through the document reading position X, thereafter, the second sheet P2 is conveyed into the third conveying path 32C with the rotation of the sheet ejecting roller pair 328 stopped. Because of this, the first sheet P1 ejected earlier is deterred from being pushed out by the second sheet P2 that is temporarily ejected in the ejecting space 3S for the switchback. As a result of this, the defective alignment of the ejected document sheet P is prevented.

Further, according to the present embodiment, as described above, it is not necessary to dispose another tray between the document feeding tray 30 and the document ejecting tray 31 and right under the reverse ejection opening 31 B (FIG. 2). Because of this, it is possible to alleviate the cost increase of the automatic document conveying device 3. Further, the ejecting space 3S is sufficiently secured between the document ejecting tray 30 and the document ejecting tray 31. Accordingly, the takeability of the document sheet P ejected to the document ejecting tray 31 is kept good. Further, the takeability of the document sheet P is also good in a case where the document sheet P is stuck around the document ejection opening 31A (FIG. 2).

Further, according to the present embodiment, the clutch 52 is disposed in the transmitting gear portion 53. Accordingly, the rotation direction of the third motor 51C is switched, whereby it is possible to control the conveying directions of the first sheet P1 and second sheet P2. Further, the clutch 52 is composed of the one-way clutch. Accordingly, the transmission of the rotating force to the sheet ejecting roller pair 328 and the interruption of the transmission are achieved easily and at low cost. Besides, it is possible to decide the rotation stop timing of the sheet ejecting roller pair 328 in accordance with the output result from the actuator 333. In the meantime, it is possible to use the actuator 333 as a sensor to detect that the document sheet P is smoothly conveyed from the first conveying path 32A to the second conveying path 32B, namely, that the document sheet P is stuck in the first conveying path 32A or the second conveying path 32B.

Hereinbefore, the image forming apparatus 1, which includes the automatic document conveying device 3 according to the embodiment of the present disclosure, is described. According to the present disclosure, the alignment of a plurality of sheets whose image reading is completed is stably kept in the document ejecting tray 31. As a result of this, in the image forming apparatus 1, the image forming operation is achieved stably. In the meantime, the present disclosure is not limited to this, and for example, the following modifications are employable.

(1) In the above embodiment, the form is described, in which the rotation of the sheet ejecting roller pair 328 is stopped based the fact that the actuator 333 detects the rear end portion of the document sheet P. But, the present disclosure is not limited to this. A form may be employable, in which the actuator 333 detects the tip end portion of the document sheet P; thereafter, the rotation of the sheet ejecting roller pair 328 is stopped at a predetermined timing.

(2) Further, in the above embodiment, as the sheet conveying device according to the present disclosure, the automatic document conveying device 3 is described. But, the present disclosure is not limited to this. The present disclosure may be applied to another sheet conveying device which includes a first tray, a second tray, and a conveying portion; wherein a sheet is conveyed in a switchback manner above the second tray.

According to the present disclosure, it is possible to deter the defective alignment of an ejected sheet in a sheet conveying device that includes a reverse conveying path for reversing a sheet and in an image forming apparatus that includes the sheet conveying device.

What is claimed is:

1. A sheet conveying device comprising:

a first tray in which a sheet is loaded;

a conveying portion that conveys the sheet placed in the first tray in such a way that the sheet passes through a predetermined reference position;

a second tray which is disposed under the first tray via an ejecting space and in which the sheet conveyed by the conveying portion is ejected;

a conveyance control portion that controls the conveying portion, the conveying portion includes:

a first conveying path that is formed to extend from the first tray to the reference position;

a second conveying path that is formed to extend from the reference position to the second tray;

a third conveying path that is separated from the second conveying path and communicates with the ejecting space above the second tray;

a fourth conveying path that is separated from the third conveying path and communicates with the first conveying path;

an ejecting roller pair that is disposed in the second conveying path and rotates in a first rotation direction to eject the sheet to the second tray;

a reverse roller pair that is disposed in the third conveying path and rotates in the first rotation direction to make one end of the sheet protrude into the ejecting space, thereafter, rotates in a second rotation direction opposite to the first direction to convey the sheet in a switchback manner, and reconvey the sheet from the fourth conveying path into the first conveying path; and a driving portion that generates a rotating force to rotate the ejecting roller pair and the reverse roller pair; wherein the conveyance control portion is able to execute duplex conveyance control in which the sheet passing through the reference position with a first surface opposing the reference position is reversed, the sheet is conveyed in such a way that the sheet passes through the reference position with a second surface opposing the reference position opposite to the first surface, thereafter, the sheet is ejected to the second tray; and in a case where the conveyance control portion continuously applies the duplex conveyance control to a plurality of the sheets, after a first sheet passes through the reference position with the second surface opposing the reference position, the conveyance control portion stops the rotation of the ejecting roller pair with a rear end side of the first sheet conveyed in the second conveying path nipped by the ejecting roller pair, and after a second sheet following the first sheet passes through the reference position with the first surface opposing the reference position, the conveyance control portion rotates the reverse roller pair in the first rotation direction with the rotation of the ejecting roller pair stopped, thereby making one end of the second sheet protrude from the third conveying path into the sheet ejecting space.

2. The sheet conveying device according to claim 1, wherein in the duplex conveyance control, the conveyance control portion makes the one end of the second sheet protrude from the third conveying path into the ejecting space, thereafter, when rotating the reverse roller pair in the second rotation direction to convey the second sheet in the switchback manner, the conveyance control portion rotates the ejecting roller pair in the first rotation direction to eject the first sheet onto the second tray.

3. The sheet conveying device according to claim 1, wherein the driving portion is composed of a single motor that rotates in the first rotation direction and in the second rotation direction opposite to the first rotation direction, the conveying portion has a drive transmitting mechanism that transmits a first rotating force generated by rotation of the driving portion in the first rotation direction to the reverse roller pair and to the sheet ejecting roller pair, and that transmits a second rotating force generated by rotation of the driving portion in the second rotation direction to the reverse roller pair and interrupts transmission of the second rotating force to the ejecting roller pair, the ejecting roller pair is rotated in the first rotation direction by the first rotating force and ejects the sheet to the second tray, in a case where the reverse roller pair is rotated in the second rotation direction by the first rotating force, the reverse roller pair conveys the sheet, whose one end protrudes into the ejecting space, from the third conveying path into the fourth conveying path, and in a case where the reverse roller pair is rotated in the first rotation direction by the second rotating force, the reverse roller pair conveys the sheet in such a way that the one end of the sheet protrudes from the third conveying path into the ejecting space.

4. The sheet conveying device according to claim 3, wherein the drive transmitting mechanism includes:

a first transmitting portion that transmits the rotating force generated by the driving portion to the ejecting roller pair, a second transmitting portion that transmits the rotating force to the reverse roller pair, wherein the first transmitting portion includes a one-way clutch that transmits the first rotating force only to the ejection roller pair.

5. The sheet conveying device according to claim 1, further comprising:

a detecting portion that is disposed in the second conveying path and detects a tip end portion or rear end portion of the sheet, wherein the conveyance control portion stops the rotation of the ejection roller pair in accordance with a detection result from the detecting portion.

6. The sheet conveying device according to claim 5, wherein the conveyance control portion switches the rotating and driving of the driving portion from the first rotation direction to the second rotation direction in accordance with the detection result from the detecting portion.

7. The sheet conveying device according to claim 1, wherein the reference position is a document reading position that is disposed to oppose a reading device that reads document images formed on the first surface and second surface of the sheet.

8. An image forming apparatus which incorporates a sheet conveying device according to claim 1.

* * * * *